US007150225B2

(12) United States Patent
Aoki

(10) Patent No.: US 7,150,225 B2
(45) Date of Patent: Dec. 19, 2006

(54) MOVING MEMBER FIXING APPARATUS

(75) Inventor: Takanobu Aoki, Ibaraki (JP)

(73) Assignee: Komori Corporation, Tokyo (JP)

( * ) Notice: Subject to any disclaimer, the term of this patent is extended or adjusted under 35 U.S.C. 154(b) by 216 days.

(21) Appl. No.: 10/938,181

(22) Filed: Sep. 10, 2004

(65) Prior Publication Data

US 2005/0056172 A1 Mar. 17, 2005

(30) Foreign Application Priority Data

Sep. 11, 2003 (JP) ..... 2003-319513

(51) Int. Cl.
*B41F 5/02* (2006.01)

(52) U.S. Cl. ..... 101/230; 101/216; 101/248

(58) Field of Classification Search ..... 101/216, 101/230, 248, 408, 409, 410
See application file for complete search history.

(56) References Cited

U.S. PATENT DOCUMENTS 5,584,241 A * 12/1996 Yuasa ..... 101/230
5,802,920 A * 9/1998 Becker ..... 74/439
2001/0050013 A1* 12/2001 Kawabata ..... 101/248

FOREIGN PATENT DOCUMENTS

| | | |
|---|---|---|
| GB | 1389877 | 4/1975 |
| JP | 2000-052535 A | 2/2000 |
| JP | 2000052535 | 2/2000 |

* cited by examiner

*Primary Examiner*—Ren Yan
(74) *Attorney, Agent, or Firm*—Blakely Sokoloff Taylor & Zafman

(57) ABSTRACT

A moving member fixing apparatus includes a stationary cam, moving cam, printing press motor, drive connecting/disconnecting mechanism, fixing/releasing device, and air cylinder. The moving cam is movable with respect to the stationary cam. The printing press motor is drive-connected to the moving cam, and moves the moving cam with respect to the stationary cam. The drive connecting/disconnecting mechanism connects/disconnects drive connection from the printing press motor to the moving cam. The fixing/releasing device fixes and releases the moving cam with respect to the stationary cam. The air cylinder drives the drive connecting/disconnecting mechanism and fixing/releasing device.

18 Claims, 6 Drawing Sheets

MOVING MEMBER FIXING APPARATUS

BACKGROUND OF THE INVENTION

The present invention relates to a moving member fixing apparatus which moves a moving member, fixed to and released from a stationary member, in a released state with respect to the stationary member.

As the most typical example of a moving member fixing apparatus of this type, a printing switching apparatus for a sheet-fed offset rotary printing press with a convertible press mechanism is available which can perform both single-sided printing and double-sided printing with one printing press. Such a printing switching apparatus has a drive connecting/disconnecting means for connecting and disconnecting drive connection from an auxiliary motor to a moving cam, and a fixing/releasing means for fixing and releasing the moving cam to and from a stationary cam. In this structure, to adjust the opening/closing timing of the gripper of an impression cylinder, the moving cam in contact with a cam follower that opens and closes the gripper is moved toward the surface of the impression cylinder, to adjust the phase of the moving cam.

A conventional moving member fixing apparatus has a moving cam fixing air cylinder serving as a fixing/releasing means for fixing and releasing a moving cam to and from a stationary cam, an auxiliary motor which moves the moving cam to adjust the phase with respect to the stationary cam, and a gear connecting air cylinder serving as a drive connecting/disconnecting means for transmitting and disconnecting the drive of the auxiliary motor to the moving cam. In this structure, the drive of the auxiliary motor can be transmitted to the moving cam through the gear connecting air cylinder. Then, the moving cam fixing air cylinder releases the moving cam from the stationary cam, and the auxiliary motor is driven, so that the moving cam is switched to a phase for double-sided printing (see Japanese Patent Laid-Open No. 2000-52535).

The conventional moving member fixing apparatus requires two air cylinders, i.e., the moving cam fixing air cylinder serving as the fixing/releasing means for fixing and releasing the moving cam to and from the stationary cam, and the gear connecting air cylinder which transmits or disconnects the drive of the auxiliary motor to the moving cam. Accordingly, not only the number of components increases, but also the apparatus becomes large in size and the structure is complicated.

SUMMARY OF THE INVENTION

It is an object of the present invention to provide a moving member fixing apparatus in which the number of components is decreased, so that the apparatus is downsized and the structure is simplified.

In order to achieve the above object, according to the present invention, there is provided a moving member fixing apparatus comprising a stationary member, a moving member movable with respect to the stationary member, driving means, drive-connected to the moving member, for moving the moving member with respect to the stationary member, drive connecting/disconnecting means for connecting/disconnecting drive connection from the driving means to the moving member, fixing/releasing means for fixing and releasing the moving member with respect to the stationary member, and an actuator which drives the drive connecting/disconnecting means and fixing/releasing means.

DESCRIPTION OF THE PREFERRED EMBODIMENTS

A moving member fixing apparatus according to the first embodiment of the present invention will be described with reference to FIGS. 1 to 5.

Figure 1:
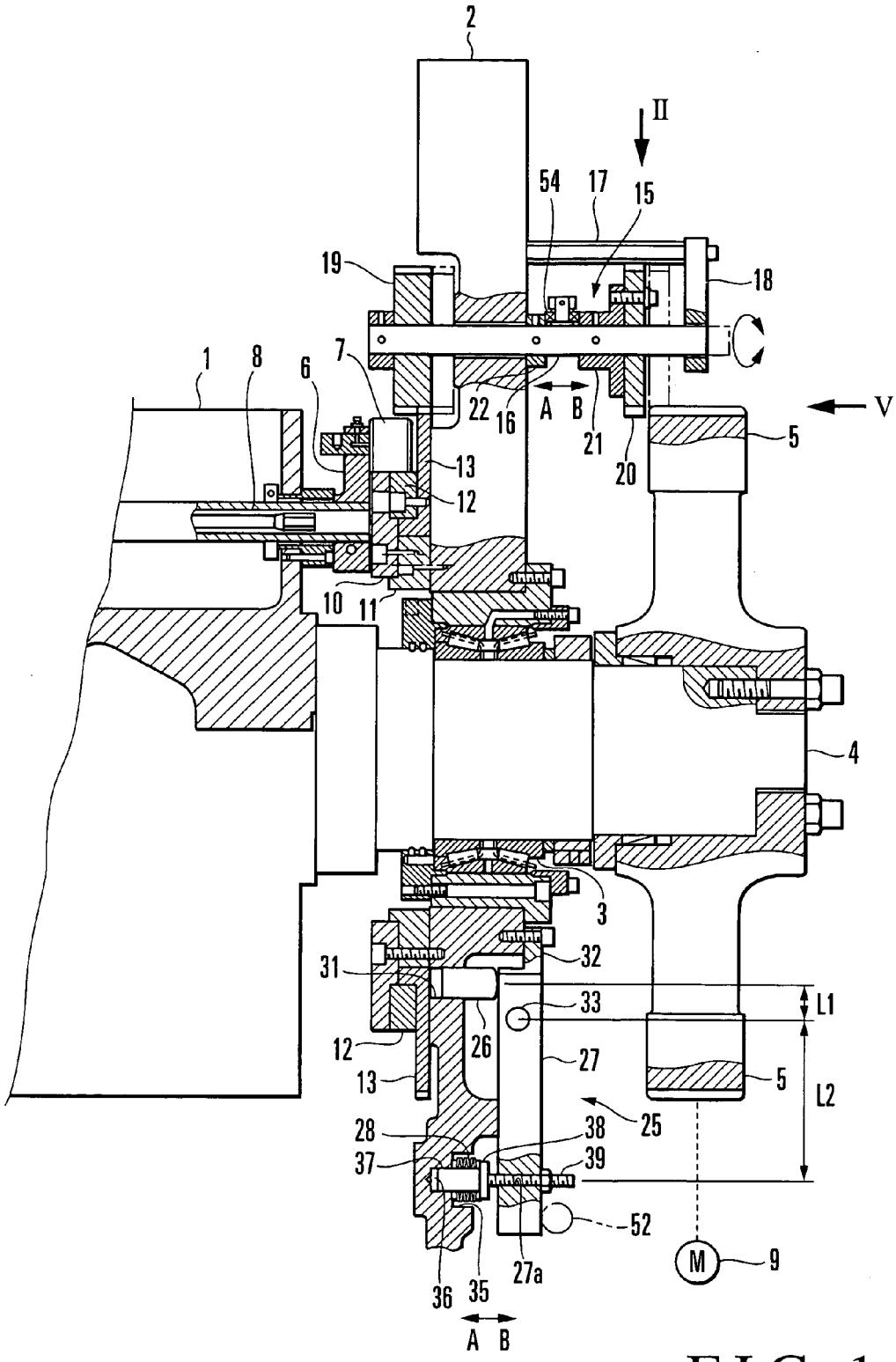
FIG. 1 is a cutaway front view showing a moving member fixing apparatus according to the first embodiment of the present invention.

Referring to FIG. 1, an end shaft 4 of an impression cylinder 1 is rotatably, axially supported by a bearing 3 fixed to a frame 2 of a printing press. A cylinder gear (first driving gear) 5 driven to rotate by a printing press motor 9 is fixed to the distal end of the end shaft 4. A cam follower 7 pivotally supported by a cam lever 6 is fixed to the end of the impression cylinder 1. The cam follower 7 is biased by the torsional moment of a torsion bar 8 having one end fixed to the other end (not shown) side of the impression cylinder 1, in directions to engage with a stationary cam 10 serving as a stationary member (to be described later) and a moving cam 12 serving as a moving member.

When the cam follower 7 engages with the cam 10 or 12, the gripper (not shown) of the impression cylinder 1 is opened and closed. The cam follower 7 engages with the stationary cam 10 when transferring a sheet with a cylinder upstream in a sheet convey direction of the impression cylinder 1, to open and close the gripper. The cam follower 7 engages with the moving cam 12 when transferring a sheet with a cylinder downstream in the sheet convey direction of the impression cylinder 1, to open and close the gripper.

The stationary cam 10 is fixed to the frame 2 through a ring member 11. The moving cam 12 is fixed to a large-diameter gear (second driving gear) 13 rotatably supported by the ring member 11. When a fixing/releasing device 25 (to be described later) brings the opposing surfaces of the stationary cam 10 and moving cam 12 into contact with each other, the moving cam 12 is fixed to the stationary cam 10, and rotation of the large-diameter gear 13 is regulated. When the fixing/releasing device 25 releases the moving cam 12 from the stationary cam 10, phase change (movement) of the moving cam 12 and stationary cam 10 through the large-diameter gear 13 with respect to the circumferential direction of the impression cylinder 1 is enabled.

A drive connecting/disconnecting mechanism 15 which connects/disconnects the drive between the cylinder gear 5 (printing press motor 9) and large-diameter gear 13 will be described.

Figure 2:
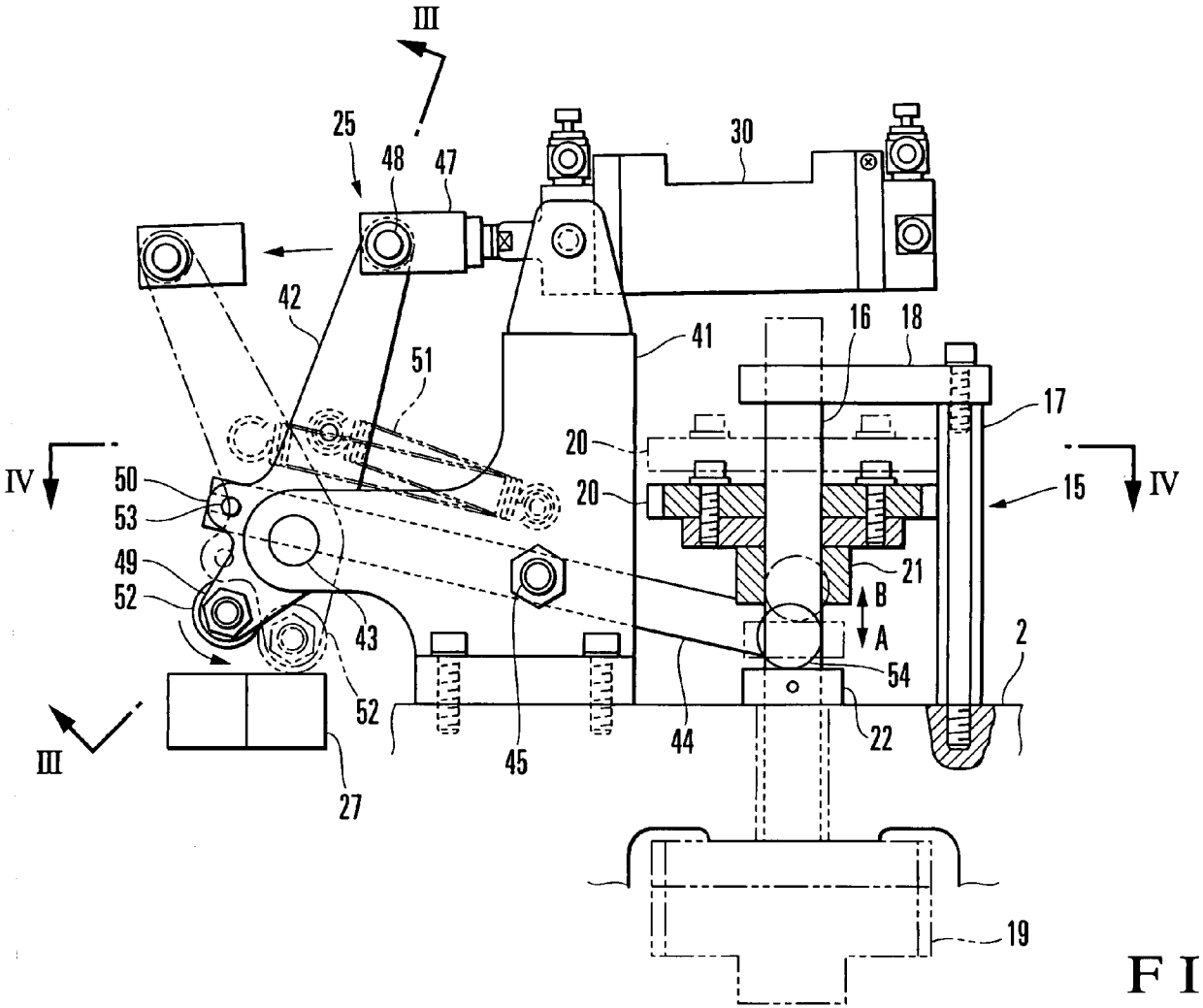
FIG. 2 is a view seen from a direction of an arrow II of FIG. 1.

As shown in FIG. 2, the drive connecting/disconnecting mechanism 15 includes a first lever 42 (to be described later) which is driven to swing by an air (fluid pressure) cylinder 30 serving as an actuator, a second lever 44 (to be described later) which is connected to the first lever 42 and pivots, a shaft 16 which is driven by the pivot motion of the second lever 44 and moves in the axial direction, and a gear (first connection gear) 20 which is fixed to the shaft 16 and meshes in a connected state with the cylinder gear 5. When a second wheel 54 engages with an engaging member 21 and presses it, the shaft 16 moves in a direction to come close to the cylinder gear 5, and the cylinder gear 5 and gear 20 mesh with each other. When the second wheel 54 engages with a stopper 22 and presses it, the shaft 16 moves in a direction to separate from the cylinder gear 5, and the cylinder gear 5 and gear 20 disengage from each other.

The shaft 16 is supported between the frame 2 and a support plate 18 fixed to the frame 2 through studs 17, to be rotatable and movable in the axial direction. A gear (second connection gear) 19 having a large facewidth so as to mesh with the large-diameter gear 13 constantly is fixed to one end of the shaft 16 which projects inside the frame 2. The gear 20 which meshes with or disengages from the cylinder gear 5 is fixed through the engaging member 21 to the other end of the shaft 16 which projects outside the frame 2. A stopper 22 is fixed to the shaft 16 at a predetermined space from the engaging member 21.

The fixing/releasing device 25 which fixes and releases the moving cam 12 with respect to the stationary cam 10 will be described.

Figure 5:
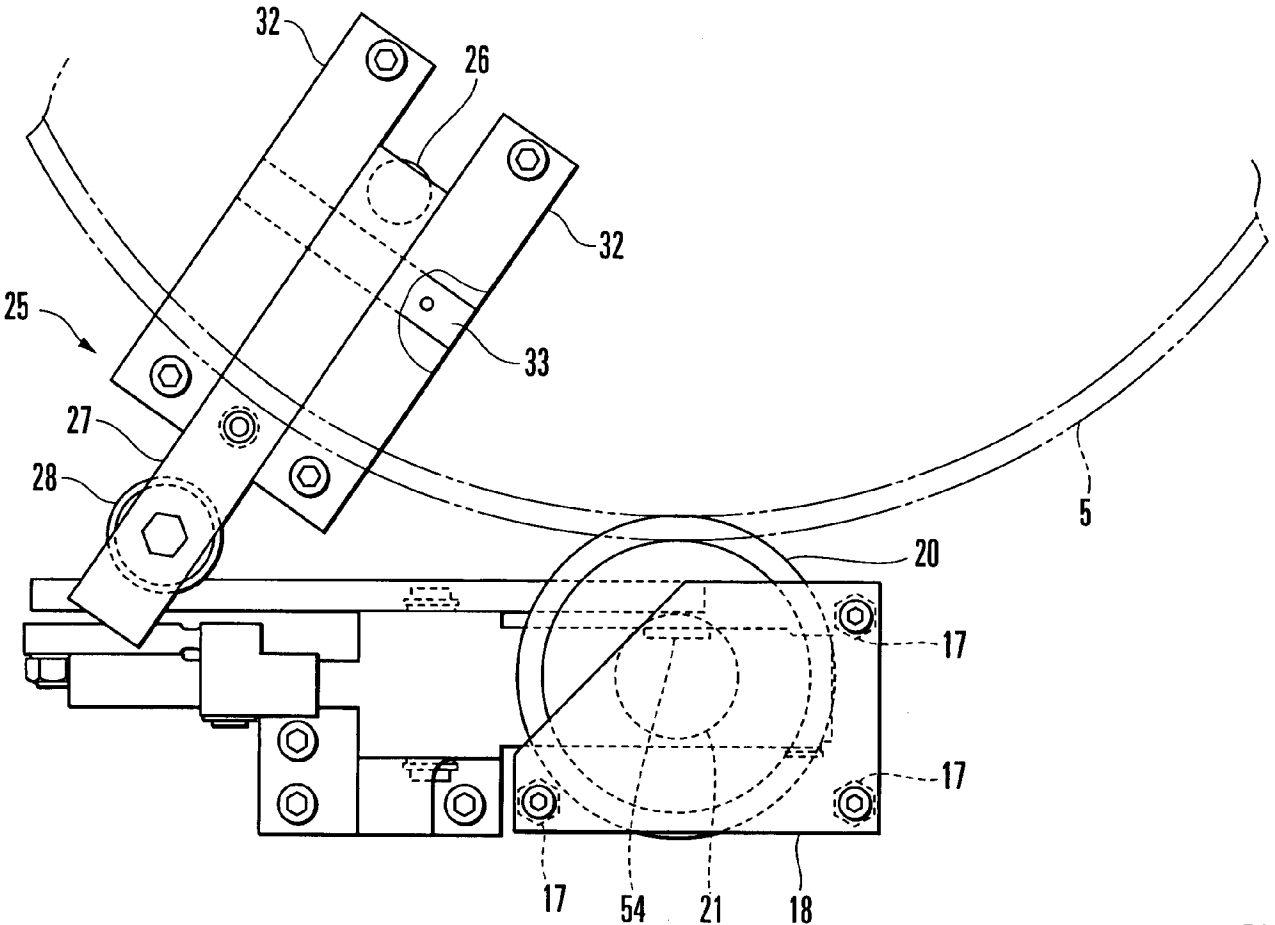
FIG. 5 is a view seen from a direction of an arrow V of FIG. 1.

As shown in FIGS. 1 and 5, the fixing/releasing device 25 includes a press member 26 which presses the moving cam 12 against the stationary cam 10, a lever 27 which engages with the press member 26, a coned disc spring 28 serving as a biasing means for biasing the lever 27 in a direction to press the press member 26, and the first lever 42 which releases the press operation of the lever 27 for the press member 26 against the biasing force of the coned disc spring 28. The first lever 42 is one of elements that form the drive connecting/disconnecting mechanism 15, as described above, and is driven by the air cylinder 30.

The press member 26 is slidably supported in a through hole 31 (FIG. 1) formed in the frame 2, such that one end of the press member 26 projects outside the frame 2 from the through hole 31. As shown in FIG. 5, a pair of support plates 32 are fixed to the frame 2 so as to oppose each other at a gap. A shaft 33 horizontally extends between the pair of support plates 32. The lever 27 is supported to be pivotal clockwise and counterclockwise in FIG. 1 about the shaft 33 as the pivot center. The press member 26 is in contact with one end of the lever 27.

As shown in FIG. 1, a blind hole 36 in which a press element 37 fits slidably is formed at the center of a recess 35 of the frame 2. The press element 37 threadably engages with a tapped hole 27*a* formed in one end of the lever 27, and has a flange 38 at its end exposed from the blind hole 36. A screw 39 which threadably engages with a tapped hole 27*a* formed in the other end of the lever 27 integrally projects from the center of the flange 38. In this state, the press element 37 is fixed to the lever 27. The coned disc spring 28 is elastically mounted between the flange 38 of the press element 37 and the bottom of the recess 35. The spring force of the coned disc spring 28 biases the lever 27 counterclockwise through the press element 37 about the shaft 33 as the pivot center.

When the lever 27 pivots, the press member 26 engaging with the other end of the e lever 27 moves in a direction of an arrow A. As the press member 26 moves in the direction of the arrow A, it presses the large-diameter gear 13 in the direction of the arrow A. The moving cam 12 fixed to the large-diameter gear 13 comes into tight contact with the stationary cam 10, so that the moving cam 12 is fixed to the stationary cam 10. A length L2 from the shaft 33 to that portion of the lever 27 which threadably engages with the screw 39 is set to be larger than a length Li between the shaft 33 and that portion of the lever 27 which engages with the press member 26.

Figure 3:
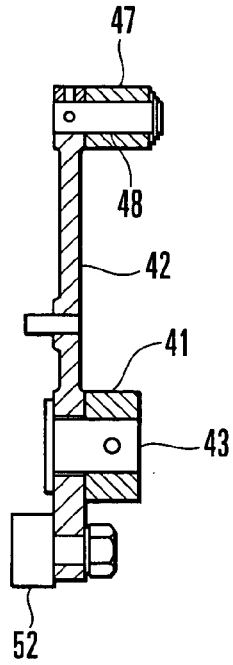
FIG. 3 is a sectional view taken along the line III—III of FIG. 2.

As shown in FIG. 2, an air cylinder 30 is pivotally mounted on the upper end of a bracket 41 standing vertically from the frame 2. The first lever 42 having the sectional shape shown in FIG. 3 is pivotally supported at the side end of the bracket 41 through a pin 43, and the second lever 44 is pivotally supported at the center of the bracket 41 through a pin 45. The proximal end of the first lever 42 is pivotally mounted on an actuating rod 47 of the air cylinder 30 through a pin 48. The first lever 42 has two swing ends, i.e., first and second swing ends 49 and 50. The tensile force of a tensile coil spring 51 suspending between the first lever 42 and bracket 41 biases the first lever 42 clockwise about the pin 43 as the pivot center.

A first wheel 52 serving as the first engaging portion is pivotally supported by the first swing end 49. The first wheel 52 presses the lever 27 when the actuating rod 47 of the air cylinder 30 moves forward and the first lever 42 pivots counterclockwise about the pin 43 as the pivot center against the tensile force of the tensile coil spring 51. As the first wheel 52 presses the lever 27, the lever 27 pivots clockwise (FIG. 1) about the shaft 33 as the pivot center against the spring force of the coned disc spring 28. Hence, the moving cam 12 fixed to the stationary cam 10 by the press member 26 is released.

Figure 4:
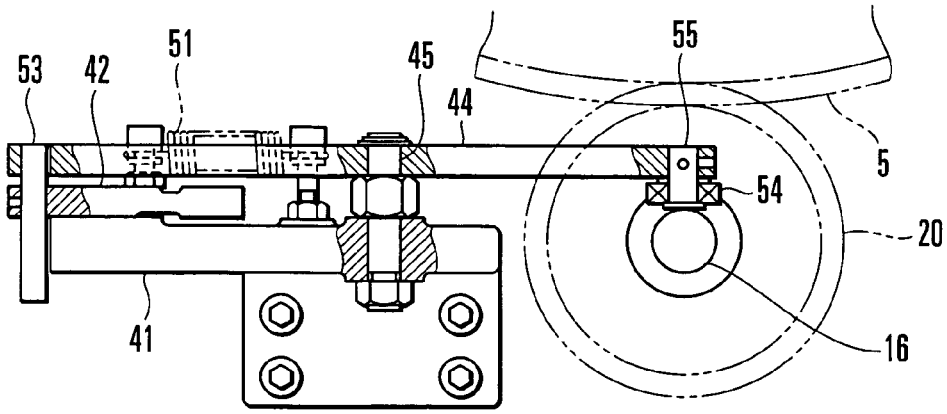
FIG. 4 is a sectional view seen from the line of arrows IV—IV of FIG. 2.

One end of the second lever 44 is pivotally mounted on the second swing end 50 of the first lever 42 through a pin 53. As shown in FIG. 4, the second wheel 54 serving as the second engaging portion is pivotally supported by the other end of the second lever 44 through a pin 55. The second wheel 54 is interposed between the engaging member 21 of the drive connecting/disconnecting mechanism 15 and the stopper 22. When the actuating rod 47 of the air cylinder 30 is retreated, the second wheel 54 moves the shaft 16 in the direction of the arrow A through the stopper 22, as indicated by a solid line in FIG. 2. Hence, the gear 20 and cylinder gear 5 meshing with each other are released, as shown in FIG. 1.

When the actuating rod 47 of the air cylinder 30 moves forward and the first lever 42 pivots counterclockwise in FIG. 2 about the pin 43 as the pivot center, the second lever 44 pivots counterclockwise in FIG. 2 about the pin 45 as the pivot center. Hence, the second wheel 54 moves the shaft 16 in the direction of the arrow B through the engaging member 21, and the gear 20 meshes with the cylinder gear 5, as indicated by an alternate long and two short dashed line in FIG. 1.

When the actuating rod 47 of the air cylinder 30 moves forward, first, the gear 20 meshes with the cylinder gear 5 by the drive connecting/disconnecting mechanism 15. After that, the fixing/releasing device 25 releases the moving cam 12 from the stationary cam 10. When the actuating rod 47 of the air cylinder 30 moves backward, first, the fixing/releasing device 25 fixes the moving cam 12 to the stationary cam 10. After that, the drive connecting/disconnecting mechanism 15 releases the gear 20 and cylinder gear 5 from each other.

In the moving member fixing apparatus having the above structure, the moving operation of the moving member with respect to the stationary member will be described.

When the actuating rod 47 of the air cylinder 30 is retreated, as shown in FIG. 1, the moving cam 12 is fixed to the stationary cam 10, and the gear 20 is released from the cylinder gear 5. In this state, when the actuating rod 47 of the air cylinder 30 moves forward, the first lever 42 pivots counterclockwise in FIG. 2 about the pin 43 as the pivot center against the tensile force of the tensile coil spring 51. As the first lever 42 pivots, the second lever 44 pivots counterclockwise in FIG. 2 about the pin 45 as the pivot center. Hence, the second wheel 54 engages with the engaging member 21 and the shaft 16 moves in the direction of the arrow B. The gear 20 and cylinder gear 5 mesh with each other, as indicated by an alternate long and two short dashed line in FIG. 1.

When the actuating rod 47 of the air cylinder 30 further moves forward and the first lever 42 pivots counterclockwise about the pin 43 as the pivot center, the first wheel 52 presses the lever 27. As the first wheel 52 presses the lever 27, in FIG. 1, the lever 27 pivots clockwise about the shaft 33 as the pivot center against the spring force of the coned disc spring 28, and the moving cam 12 fixed to the stationary cam 10 by the press member 26 is released.

As described above, the moving cam 12 fixed to the stationary cam 10 is released after the gear 20 and cylinder gear 5 mesh with each other (drive connection is connected). Therefore, the moving cam 12 will not become rotatable temporarily, and a positional shift in the rotational direction of the moving cam 12 can be regulated.

Subsequently, the cylinder gear 5 meshing with the gear 20 is pivoted by the printing press motor 9 for a predetermined amount, so the large-diameter gear 13 pivots for a predetermined amount through the gear 20, shaft 16, and gear 19. At this time, the moving cam 12 also moves integrally for a predetermined amount, and phase adjustment for the stationary cam 10 is performed. Then, when the actuating rod 47 of the air cylinder 30 moves backward, the lever 42 pivots clockwise in FIG. 2 about the pin 43 as the pivot center to locate at the position indicated by a solid line in FIG. 2, to release the lever 27 from the first wheel 52.

The released lever 27 is pivoted counterclockwise in FIG. 1 about the shaft 33 as the pivot center by the spring force of the coned disc spring 28. One end of the lever 27 moves the press member 26 in the direction of the arrow A, so that the press member 26 presses the moving cam 12 against the stationary cam 10. Hence, the moving cam 12 is fixed to the stationary cam 10. Subsequently, when the actuating rod 47 of the air cylinder 30 moves backward, the second lever 44 pivots clockwise in FIG. 2 about the pin 45 as the pivot center. As the second lever 44 pivots, the second wheel 54 moves in the direction of the arrow A in FIG. 1, to release the gear 20 and cylinder gear 5 from each other.

As described above, after the moving cam 12 is fixed to the stationary cam 10, the gear 20 and cylinder gear 5 are released (drive connection is disconnected) from each other. Once the phase of the moving cam 12 with respect to the stationary cam 10 is adjusted, the moving cam 12 will not shift. Thus, accurate phase adjustment can be performed.

According to this embodiment, fixing/releasing of the moving cam 12 with respect to the stationary cam 10 and connection/disconnection of drive to move the moving cam 12 with respect to the stationary cam 10 are performed with one air cylinder 30. Thus, the number of components is decreased, so that the apparatus can be downsized and the structure can be simplified.

The length L2 from the shaft 33 to that portion of the lever 27 which threadably engages with the screw 39 is set larger than the length Li from the shaft 33 to that portion of the lever 27 which engages with the press member 26, so that the principle of lever can be employed. With the leverage, the spring force of the coned disc spring 28 is amplified to press the press member 26. Thus, the spring force of the coned disc spring 28 can be decreased. The driving force of the air cylinder 30 itself which pivots the lever 27 against the spring force of the coned disc spring 28 can also be decreased. Consequently, as the air cylinder 30, one having a small outer size can be used, and the space in the apparatus where the air cylinder 30 is to be installed can be decreased.

When the drive connecting/disconnecting mechanism 15 performs disconnection, the cylinder gear 5 and gear 20 can be released from each other. Thus, early wear of the gears 5 and 20 can be prevented.

Figure 6:
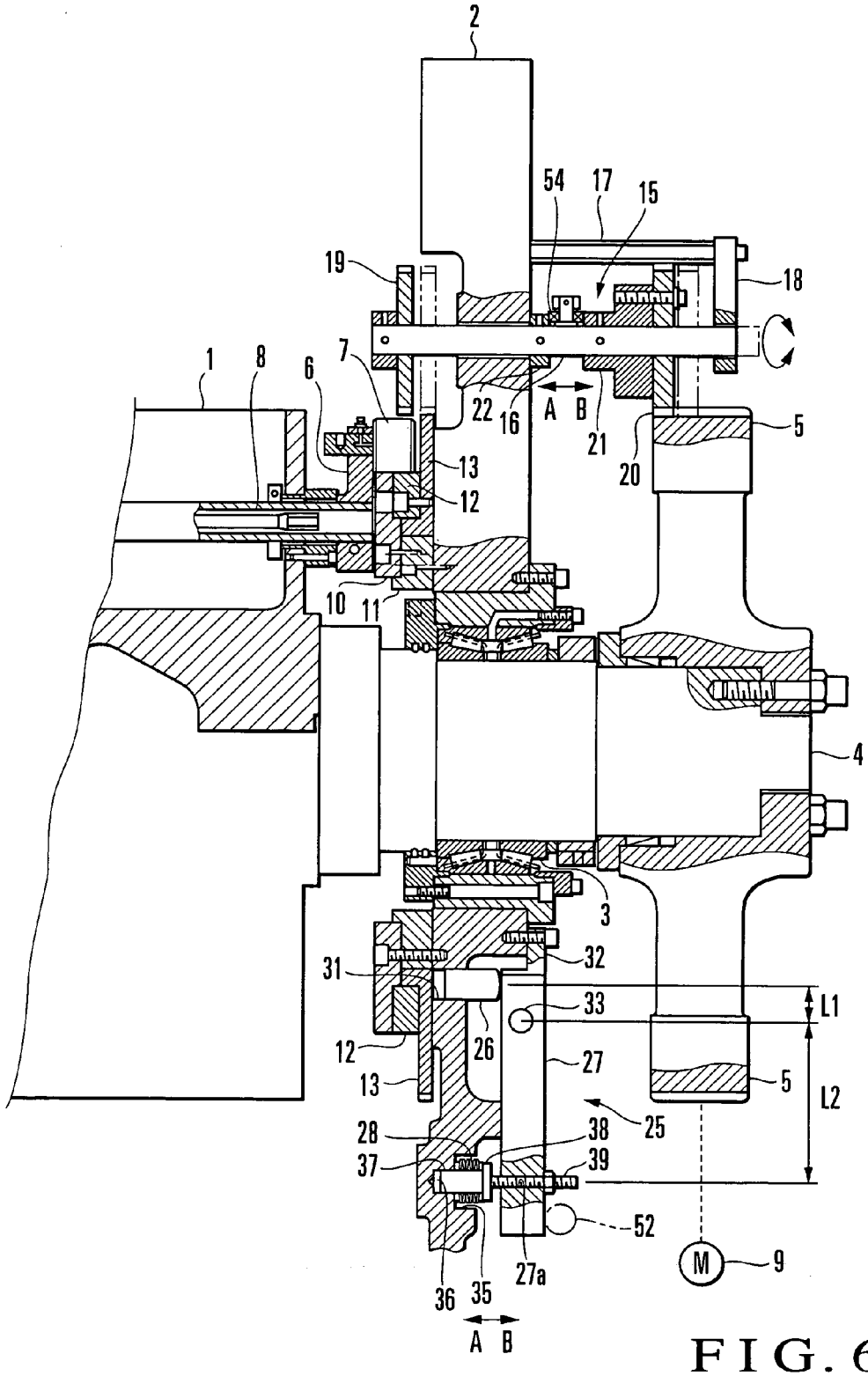
FIG. 6 is a cutaway front view showing a moving member fixing apparatus according to the second embodiment of the present invention.

A moving member fixing apparatus according to the second embodiment of the present invention will be described with reference to FIG. 6.

In the second embodiment, even when a shaft 16 moves in directions of arrows A and B, a gear 20 keeps meshing with a cylinder gear 5. A gear 19 meshes with a large-diameter gear 13 when the shaft 16 moves in the direction of the arrow B, and releases from the large-diameter gear 13 when the shaft 16 moves in the direction of the arrow A. With this arrangement, as the shaft 16 is moved in the direction of the arrow B and the cylinder gear 5 is driven to rotate by a printing press motor 9, the phase of a moving cam 12 with respect to a stationary cam 10 is adjusted.

Figure 7:
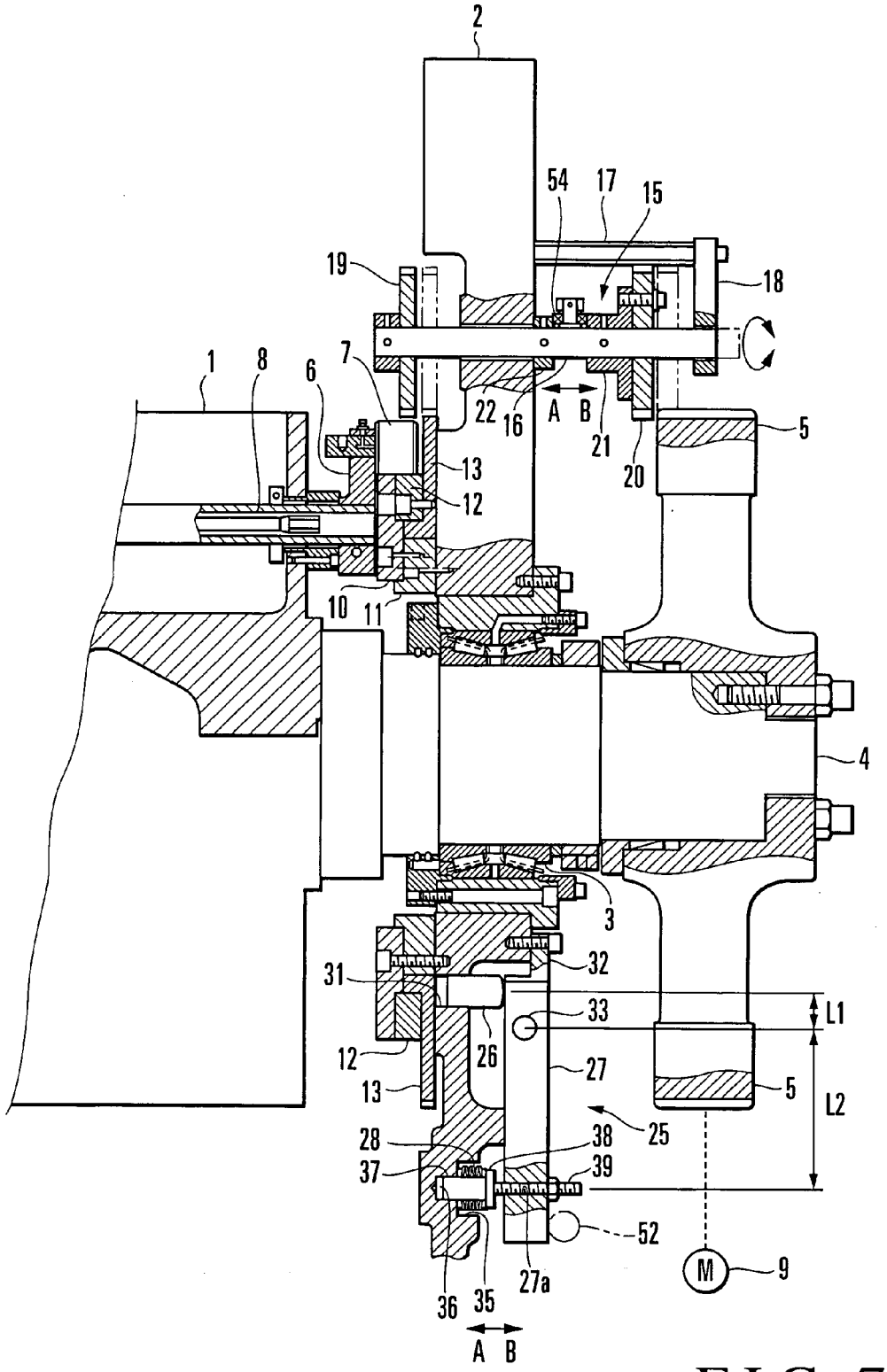
FIG. 7 is a cutaway front view showing a moving member fixing apparatus according to the third embodiment of the present invention.

A moving member fixing apparatus according to the third embodiment of the present invention will be described with reference to FIG. 7.

In the third embodiment, when a shaft 16 moves in a direction of an arrow B, a gear 19 meshes with a large-diameter gear 13, and a gear 20 meshes with a cylinder gear 5. In this state, when a printing press motor 9 is driven to rotate the cylinder gear 5, the phase of a moving cam 12 with respect to a stationary cam 10 is adjusted. When the shaft 16 moves in a direction of an arrow A, the gear 19 is released from the large-diameter gear 13, and the gear 20 is released from the cylinder gear 5.

In the respective embodiments described above, a printing switching apparatus for a sheet-fed offset rotary printing press with a convertible press mechanism is described. The present invention can also be applied to phase adjustment for a cam in a folding machine and coater switching device for a coater apparatus. The moving cam 12 is fixed to the stationary cam 10. Alternatively, in an apparatus that does not require a stationary cam, a frame can be used as a target to be fixed.

The stationary cam 10 and moving cam 12 are used as the stationary member and moving member, respectively. Alternatively, in a stationary gear and moving gear provided to a convertible cylinder, the moving gear may be fixed to and released from the stationary gear. The second lever 44 is supported by the second swing end 50 of the first lever 42 through the pin 53. Alternatively, no second swing end 50 need be provided, and the second lever 44 may be supported by any portion of the first lever 42 through the pin 53.

The second wheel 54 supported by the second lever 44 is interposed between the engaging member 21 supported by the shaft 16 and the stopper 22. However, the present invention is not limited to this. More specifically, the second wheel 54 may be supported by the shaft 16. An engaging member to clamp the second wheel 54 may be provided to the second lever 44. The second wheel 54 may be clamped by the engaging member, so that the shaft 16 may be moved.

The first wheel 52 is provided to the first lever 42. Alternatively, the first wheel 52 may be supported by the lever 27. No first wheel 52 need be provided, and the lever 27 may be swung by the first lever 42 directly.

The two gears 19 and 20 are used between the cylinder gear 5 and large-diameter gear 13. Alternatively, only one common gear may be used. In this case, in the connected state, the cylinder gear 5 and large-diameter gear 13 mesh with the common gear simultaneously. In the disconnected state, at least one of the cylinder gear 5 and large-diameter gear 13 meshing with the common gear is released. The gears 19 and 20 are fixed to the shaft 16. Alternatively, the gears 19 and 20 may be slidably supported by the shaft. In this case, the gears 19 and 20 may move in the axial direction of the shaft while they are drive-connected to each other.

When the rod 47 of the air cylinder 30 stretches, the lever 42 swings to the position (FIG. 2) indicated by an alternate long and two short dashed line. Alternatively, the air cylinder may be set in the opposite direction, so that the lever 42 swings in the same manner when the rod 47 retracts.

According to the present invention, only one air cylinder is employed to decrease the number of components, so that the apparatus can be downsized and the structure can be simplified. As the positional displacement of the moving member with respect to the stationary member can be regulated, the moving member can be positioned accurately.

What is claimed is:

1. A moving member fixing apparatus in a rotary printing press comprising: a stationary member; a moving member movable with respect to said stationary member; driving means, drive-connected to said moving member, for moving said moving member with respect to said stationary member; drive connecting/disconnecting means for connecting/disconnecting drive connection from said driving means to said moving member; fixing/releasing means for fixing and releasing said moving member with respect to said stationary member; and a single actuator which drives said drive connecting/disconnecting means and fixing/releasing means.

2. An apparatus according to claim 1, further comprising: a first lever which is swung by an operation of said actuator; a first engaging portion which is provided to said first lever and actuates said fixing/releasing means; a second lever swingably supported by said first lever; and a second engaging portion which is provided to said second lever and actuates said drive connecting/disconnecting means.

3. An apparatus according to claim 2, wherein said actuator is a hydrostatic cylinder having a rod that stretches and retracts, said drive connecting/disconnecting means and then said fixing/releasing means actuate through said first and second levers when said rod of said hydrostatic cylinder moves in a first direction, said fixing/releasing means and then said drive connecting/disconnecting means actuate through said first and second levers when said rod of said hydrostatic cylinder moves in a second direction opposite to the first direction.

4. An apparatus according to claim 2, wherein said first lever has first and second swing ends, said first engaging portion comprises a first wheel supported by said first swing end of said first lever, said second lever is swingably supported by a pin, and has a first end connected to said second swing end of said first lever and a second end to be connected to said drive connecting/disconnecting means, and said second engaging portion comprises a second wheel supported by said second end of said second lever.

5. An apparatus according to claim 1, further comprising: a first lever which has first and second swing ends and is swung by an operation of said actuator; a first wheel which is provided to said first swing end and actuates said fixing/releasing means; a second lever having one end swingably supported by said second swing end; and a second wheel which is provided to the other end of said second lever and actuates said drive connecting/disconnecting means.

6. An apparatus according to claim 1, wherein said fixing/releasing means includes a press member which presses said moving member against said stationary member, a lever which engages with said press member, and biasing means for biasing said lever in a direction along which said moving member is pressed by said press member against said stationary member, and said lever is moved by an operation of said actuator in a direction to engage with said engaging member against a biasing force of said biasing means.

7. An apparatus according to claim 4, wherein $Li<L2$ is set where L1 is a length from a support shaft of said lever to a position of said lever where said lever engages with said press member, and L2 is a length from said support shaft of said lever to a position where said biasing means biases said lever.

8. An apparatus according to claim 1, wherein said drive connecting/disconnecting means includes at least one connection gear which is driven to move by said actuator, and first and second driving gears which mesh with and release from said connection gear upon movement of said connection gear, and when said connection gear meshes with said first and second driving gears, drive connection from said driving means to said moving member is performed.

9. An apparatus according to claim 8, wherein said drive connecting/disconnecting means further includes a rotatable shaft to which said connection gear is fixed, and said shaft is moved together with said connection gear by said actuator.

10. An apparatus according to claim 8, wherein when said moving member is to start moving, drive transmission from said first driving gear to said second driving gear is set in a connected state by said drive connecting/disconnecting means, and said moving member is then released from said stationary member by said fixing/releasing means.

11. An apparatus according to claim 8, wherein when said moving member is to end moving, said moving member is fixed to said stationary member by said fixing/releasing means, and drive transmission from said first driving gear to said second driving gear is then set in a disconnected state by said drive connecting/disconnecting means.

12. An apparatus according to claim 1, wherein said drive connecting/disconnecting means includes a shaft supported to be rotatable and axially movable, a first connection gear which is fixed to said shaft and meshes with a first driving gear drive-connected to said driving means, and a second connection gear which is fixed to said shaft and meshes with a second driving gear which moves said moving member with respect to said stationary member, and said shaft is actuated to move in the axial direction by said actuator, and releases at least one of said first and second driving gears respectively meshing with said first and second connection gears.

13. An apparatus according to claim 12, wherein when drive connection between said driving means and moving member is set in a connected state by said drive connecting/disconnecting means, said first and second driving gears respectively mesh with said first and second connection gears, and when drive connection between said driving means and moving member is set in a disconnected state by said drive connecting/disconnecting means, at least one of said first and second driving gears is released from a corresponding one of said first and second connection gears.

14. An apparatus according to claim 12, wherein when drive connection by said drive connecting/disconnecting means changes from a connected state to a disconnected state, a meshing state of said first driving gear with said first connection gear is released, and a meshing state of said second driving gear with said second connection gear is maintained.

15. An apparatus according to claim 12, wherein when drive connection by said drive connecting/disconnecting means changes from a connected state to a disconnected state, a meshing state of said first driving gear with said first connection gear is maintained, and a meshing state of said second driving gear with said second connection gear is released.

16. An apparatus according to claim 12, wherein when drive connection by said drive connecting/disconnecting means changes from a connected state to a disconnected state, a meshing state of said first driving gear with said first connection gear, and a meshing state of said second driving gear with said second connection gear are both released.

17. An apparatus according to claim 1, wherein said stationary member comprises a stationary cam which opens/closes a gripper provided to a cylinder in said printing press when a sheet is to be transferred between said cylinder and first sheet convey means upstream of said cylinder in a sheet convey direction, said moving member comprises a moving cam which opens/closes said gripper when a sheet is to be transferred between said cylinder and second sheet convey means downstream of said cylinder in the sheet convey direction, and said moving member changes a phase thereof in a circumferential direction of said cylinder with respect to said stationary member.

18. An apparatus according to claim 1, wherein said actuator sequentially drives said drive connecting/disconnecting means and fixing/releasing means in a predetermined order.

* * * * *